US007062918B2

(12) United States Patent
Walker et al.

(10) Patent No.: US 7,062,918 B2
(45) Date of Patent: Jun. 20, 2006

(54) DIFFUSER ARRANGEMENT

(75) Inventors: Alastair D Walker, Loughborough (GB); Paul A Denman, Loughborough (GB)

(73) Assignee: Rolls-Royce plc, London (GB)

( * ) Notice: Subject to any disclaimer, the term of this patent is extended or adjusted under 35 U.S.C. 154(b) by 173 days.

(21) Appl. No.: 10/724,628

(22) Filed: Dec. 2, 2003

(65) Prior Publication Data

US 2004/0244379 A1 Dec. 9, 2004

(30) Foreign Application Priority Data

Dec. 17, 2002 (GB) ..... 0229307.4

(51) Int. Cl.
*F02C 3/00* (2006.01)
*F02C 7/18* (2006.01)

(52) U.S. Cl. ..... 60/751; 60/785

(58) Field of Classification Search ..... 60/751, 60/785

See application file for complete search history.

(56) References Cited

U.S. PATENT DOCUMENTS 3,011,307 A * 12/1961 Edelfelt ..... 60/794
3,216,455 A * 11/1965 Cornell et al. ..... 60/200.1
4,098,073 A 7/1978 Adkins
4,471,910 A * 9/1984 de Paul et al. ..... 239/124
4,497,445 A * 2/1985 Adkins et al. ..... 60/751
4,796,429 A * 1/1989 Verdouw ..... 60/751
5,632,141 A 5/1997 Sloop
6,092,987 A 7/2000 Honda
6,334,297 B1 * 1/2002 Dailey et al. ..... 60/751

FOREIGN PATENT DOCUMENTS

| | | |
|---|---|---|
| CA | 2 199 875 A | 10/1994 |
| EP | 0 902 179 A | 3/1999 |
| EP | 1 074 792 A | 2/2001 |
| EP | 1 136 679 A | 9/2001 |
| GB | 2 122 690 A | 1/1984 |
| JP | 56162300 AB | 12/1981 |
| JP | 2001055904 AB | 2/2001 |

* cited by examiner

*Primary Examiner*—Ted Kim
(74) *Attorney, Agent, or Firm*—W. Warren Taltavull; Manelli Denison & Selter PLLC

(57) ABSTRACT

A diffuser arrangement is provided in which a wall surface of the diffuser arrangement incorporates an upstream part and a downstream part with an aperture between them. There is a step displacement between the upstream part and the downstream part along with specific shaping of the leading edge of the aperture whereby fluid air flow is drawn into the aperture from a fluid flow whilst avoiding undue disturbance to that flow. The present diffuser arrangement allows incorporation within an engine without complex fabrication or structural requirements.

17 Claims, 3 Drawing Sheets

DIFFUSER ARRANGEMENT

FIELD OF THE INVENTION

The present invention relates to diffuser arrangements and more particularly to diffuser arrangements used within gas turbine engines which utilise bleed in order to increase area ratios and divergence angles within a given length and that the bleed air can then be utilised for component cooling.

BACKGROUND OF THE INVENTION

Within a gas turbine engine it will be appreciated that a compressor stage presents an airflow to a combustion chamber where high temperatures and gas flows allow a turbine system to drive the engine. In order to achieve stable and efficient combustion it is desirable to ensure that there is a suitable air flow within the combustion stage. In such circumstances, a diffuser arrangement is provided in order to reduce airflow velocity and increase static pressure. In general terms, air is diffused or bled from the output compressor air flow. This diffused air is utilised for cooling and other purposes about the engine.

It is important when diffusing or bleeding air from the compressor stage air flow that such diffusion is achieved most efficiently and with the least degree of additional constructional complexity. It is necessary that the flow within the diffuser remains attached in order to achieve efficient diffusion—i.e. sufficient reduction in dynamic pressure and redistribution of the flow in order to achieve efficient combustion. Furthermore, in providing for such bleeding or diffusion it is necessary that the air flow from the compressor stage is maintained for efficient combustion. Initially, divergence ducts were provided in order to achieve diffusion but these may not be able to achieve desired and required higher rates of diffusion whilst the flow remains attached. It should also be understood that it is desirable to achieve a shorter engine length and such diffusion arrangements may be difficult to incorporate within the desired engine length.

An example of a previous diffuser arrangement is illustrated in European Patent Application No. 00306279.1 (Rolls-Royce Plc). In this previous diffuser arrangement air is taken from the air flow driven by the compressor using a relatively complex diffuser arrangement which must be constructed or fabricated before the combustion chamber. Clearly, incorporation of relatively complex structural features add to costs and engineering complexity.

SUMMARY OF THE INVENTION

In accordance with the present invention there is provided a diffuser arrangement for an engine, the arrangement comprising a wall surface in a fluid flow conduit and formed with an aperture between an upstream part of the wall surface and a downstream part of the wall surface, the downstream part having a step displacement away from a projected profile of the upstream part of the wall surface whereby in use flow momentum in a fluid flow past the wall surface facilitates flow bleed into the aperture.

Normally, the fluid flow is air flow from a compressor.

Preferably, the upstream part has a leading edge to the aperture shaped to enhance flow momentum thereabout towards the aperture. Typically, the edge is curved into the aperture. Normally, the edge has a curvature dependent upon expected flow rate and/or cross-section of the conduit including the wall surface. Typically, the curvature will have a radius in the order of 0.05 to 0.15 and preferably 0.09 to 0.11 of an inlet passage height h, to the conduit.

Preferably, the downstream part has a trailing edge to the aperture which is angularly presented. Typically, the down stream part will be at an angle in the order of 20 to 40° to the principal axis of fluid flow, preferably the angle is 30°.

Preferably, the step displacement of the downstream part relative to the upstream part is in the order of 0.05 to 0.12 and preferably 0.06 to 0.1 of the inlet passage height, h.

Preferably, the aperture is divergent away from an opening in the wall surface. Typically, the aperture has a width at the opening in the wall surface in the order of 0.04 to 0.07 and preferably 0.05 to 0.06 of the inlet passage height. Generally, the aperture will have an aperture wall upon the side towards the downstream part which is substantially perpendicular to the principal axis of the fluid flow.

Generally, the combined length of the wall surface will be three to four times the inlet passage height.

Possibly, the downstream part will be shaped to create a gate or barrier.

Normally, the aperture will be coupled to a cooling system for an engine in order to provide fluid as a coolant flow for that engine.

Also in accordance with the present invention there is provided an engine incorporating a diffuser arrangement as described above.

BRIEF DESCRIPTION OF THE DRAWINGS

An embodiment of the present invention will now be described by way of example only with reference to the accompanying drawings in which.

DETAILED DESCRIPTION OF THE INVENTION

Figure 1:
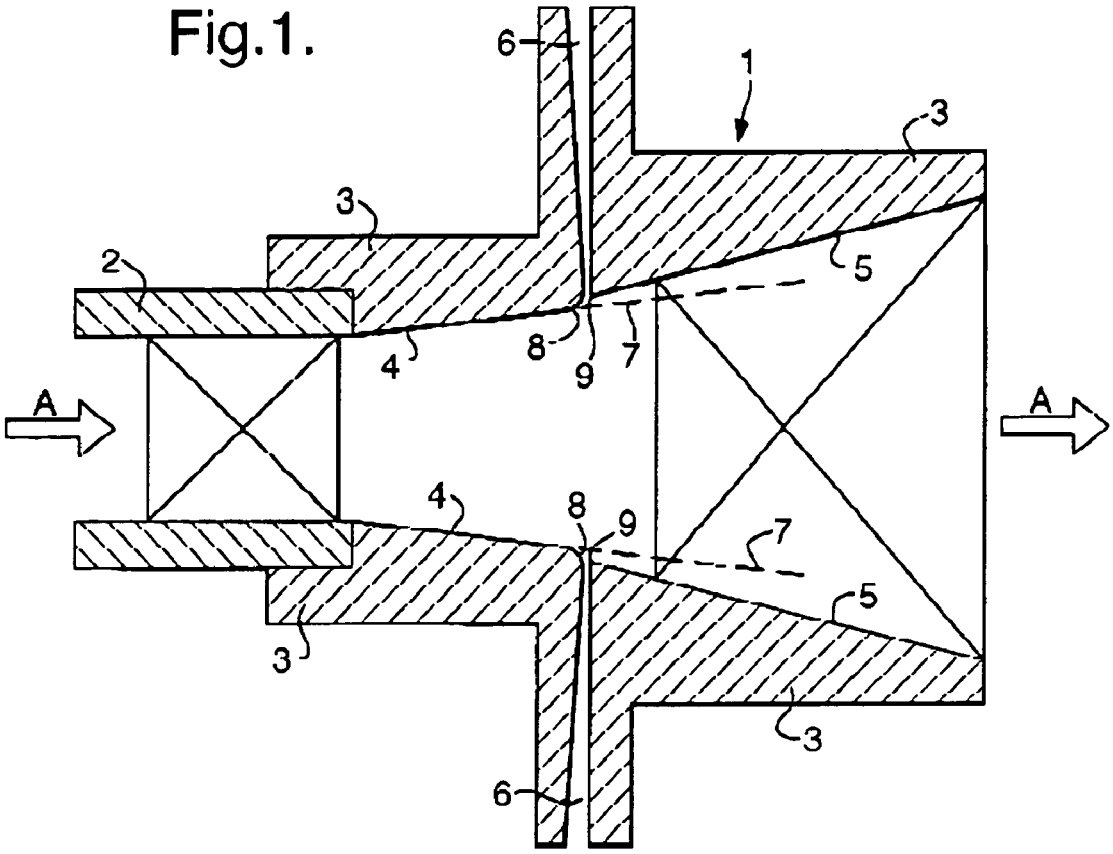
FIG. 1 is a schematic cross-section of a diffuser arrangement in accordance with the present invention.

Referring to FIG. 1 which depicts a schematic cross-section of a diffuser arrangement 1 in accordance with the present invention. Thus, the diffuser arrangement 1 includes an inlet 2 which presents a fluid or air flow in the direction of arrow head A to the diffuser arrangement 1. The arrangement incorporates wall surfaces 3 which in turn comprise an upstream part 4 and a downstream part 5 divided by an aperture 6 between these parts 4, 5. In such circumstances, the fluid air flow in the direction of arrow head A passes through the inlet 2 and out of the arrangement 1 with a proportion of that fluid air flow bled or diffused through the aperture 6. This diffused or bled air taken through the aperture 6 is utilised for cooling etc in other parts of the engine.

In accordance with the invention, the upstream parts 4 are presented such that a projected profile depicted by broken lines 7 which is a continuation of the upstream part 4 surface is not consistent with the extending surface of the downstream parts 5. The downstream parts 5 present a surface which is step displaced from that projected profile 7 such that a transfer of momentum from the air flow to the aperture reduces boundary layer development and prevents air flow separation within the diffuser arrangement 1. The specific shaping of the aperture 6, the degree of step displacement between the projected profile 7 and the downstream part 5 surface and the width of the opening to the aperture 6 are all highly determinant of performance. In such circumstances, an analysis of the overall fluid air flow within the diffuser arrangement 1 for a particular installation is required in order to determine the necessary specific factors for that installation. Detail of the specific considerations will be outlined later. It will also be understood that the leading edge 8 of the aperture 6 will be generally shaped and in particular rounded in order to create increased momentum flow directed towards the aperture 6 whilst the trailing edge 9 will generally be angularly shaped for more specific cleaving of the air flow between that directed into the aperture 6 and that allowed to continue flowing through the diffuser arrangement 1.

Figure 2:
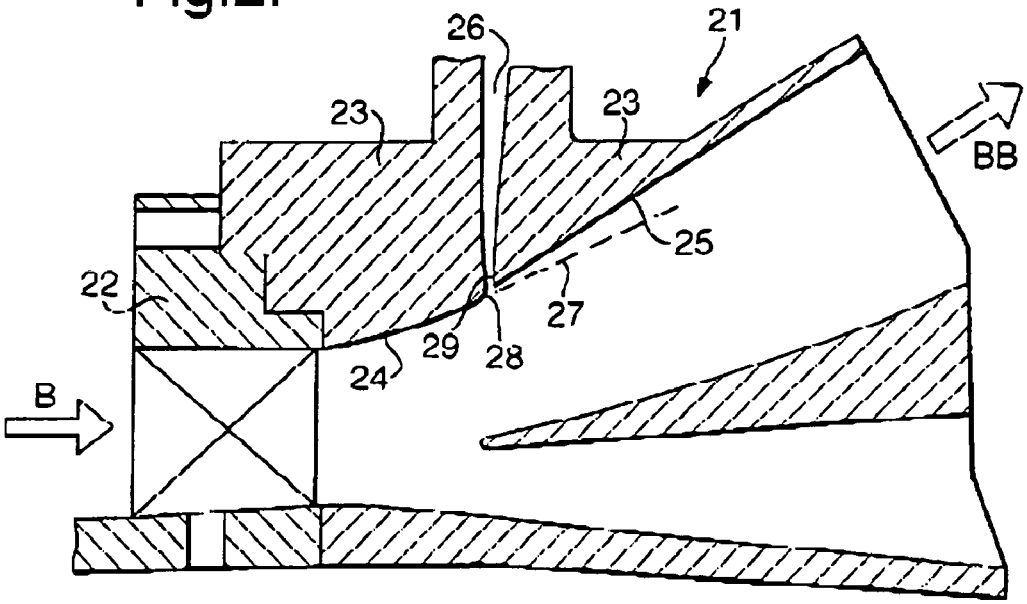
FIG. 2 is a schematic cross-section of an alternative diffuser arrangement in accordance with the present invention.

FIG. 2 illustrates an alternative schematic diffuser arrangement in accordance with the present invention. Thus, an inlet 22 is again provided through which an air flow in the direction of arrow head B is provided to the arrangement 21. However, in the arrangement 21 this air flow in the direction of arrow head B is split so that only a proportion passes in the conduit 20 in the direction of arrow head BB. To prevent separation on downstream edge 25 and thus enable the large flow deflection from B to BB air is bled through aperture 26 formed in wall surface 23 having an upstream part 24 and a downstream part 25. Again, the downstream part 25 is presented in a step displacement from a projected profile 27 taken from the upstream part 24. The edge 28 of the aperture 26 is shaped to facilitate the bleed flow into the aperture 26. A trailing edge 29 is also again angularly presented to create a wedge for more precise cleavage in the air flow.

Figure 3:
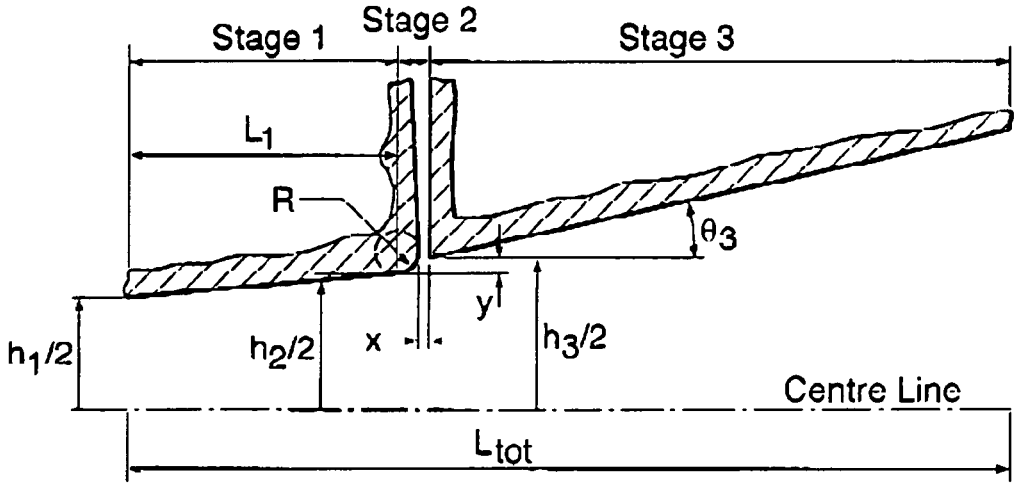
FIG. 3 is a more detailed schematic cross-section of a wall surface of a diffuser arrangement in accordance with the present invention.

As indicated above, the specific dimensions in order to create a diffuser arrangement 1, 21 in accordance with the present invention will depend upon a number of factors. These factors include the cross-sectional area of the conduit 20 through which the fluid air flow is presented, the rate of that air flow and the necessary level of diffusion from the air flow. Generally, the most critical factors are the degree of step displacement between the projected profile 7, 27 and the downstream part 5, 25 of the wall surface 3, 23 along with the specific shaping of the leading edge 8, 28 for the aperture 6, 26. FIG. 3 illustrates a number of the dimensional relationships of a diffuser arrangement 1, 21 in accordance with the present invention. Values for the integers recited in FIG. 3 are provided below in table A. For the avoidance of doubt, it should be appreciated that these dimensional parameters are given for example only and relate to a desired bleed rate of approximately 2.5% of the fluid air flow volume per unit time. Clearly, different installations will require different dimensions within the general teaching of the present description.

TABLE A

| | |
|---|---|
| Overall: | $L_{tot}/h_1$ = 3–4 giving an area ratio AR around 2.5 |
| Stage 1: | $AR_1$ = 1.1–1.45 |
| | $L/h_1$ = 1–1.3 |

TABLE A-continued

| | |
|---|---|
| Conventional design rules apply for a modest AR given available $L/h_1$ | |
| Stage 2: | $x = 0.05–0.06h_1$ |
| | $y = 0.06–0.10h_1$ |
| | $R = 0.09–0.11h_1$ |
| | $AR_2$ = 1.1–1.15 |
| Stage 3: | $AR_3$ = 1.5–2 |
| | $\theta_3 = 35°$ |

This invention provides a way of increasing pre-diffuser area ratio and/or flow deflection whilst maintaining an attached flow regime. This is achieved under the action of bleeds with the bleed air then utilised for component cooling. The flow diffuses and decelerates losing dynamic pressure which is recovered as static pressure. The diffuser arrangement can be easily incorporated within an engine without complicated fabrication or constructional difficulties. It will be understood that the present diffuser arrangement comprises an appropriately shaped aperture within a conduit wall surface and so does not require provision of relatively complicated barrier gates or vortex chambers in order to achieve the desired air flow bleeding. Nevertheless, relational considerations are required in order to achieve sufficient performance with the aperture. In particular, the leading edge and the step displacement along with the width of the opening to the aperture will generally be critical in order to achieve the desired diffusion performance. FIG. 3 and Table A provide illustrative example ranges and relationships.

Figure 4:
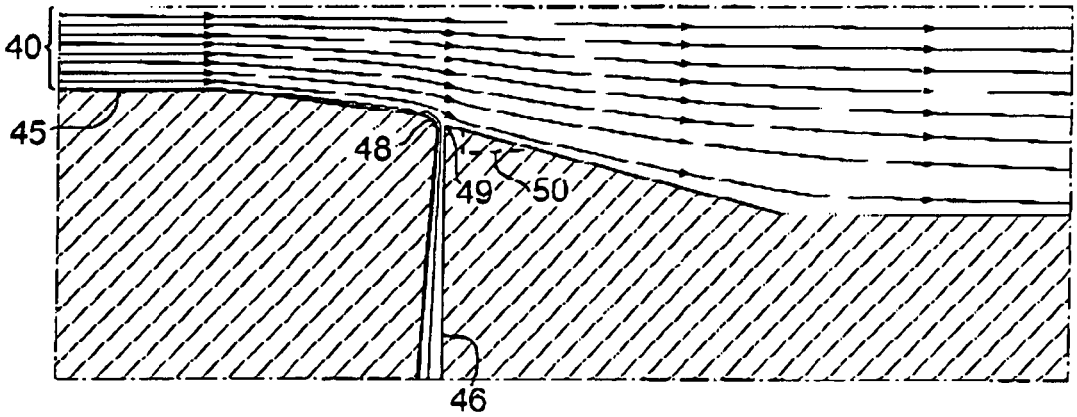
FIG. 4 is a graphic representation of air flows about an aperture in accordance with the present invention.
Figure 5:
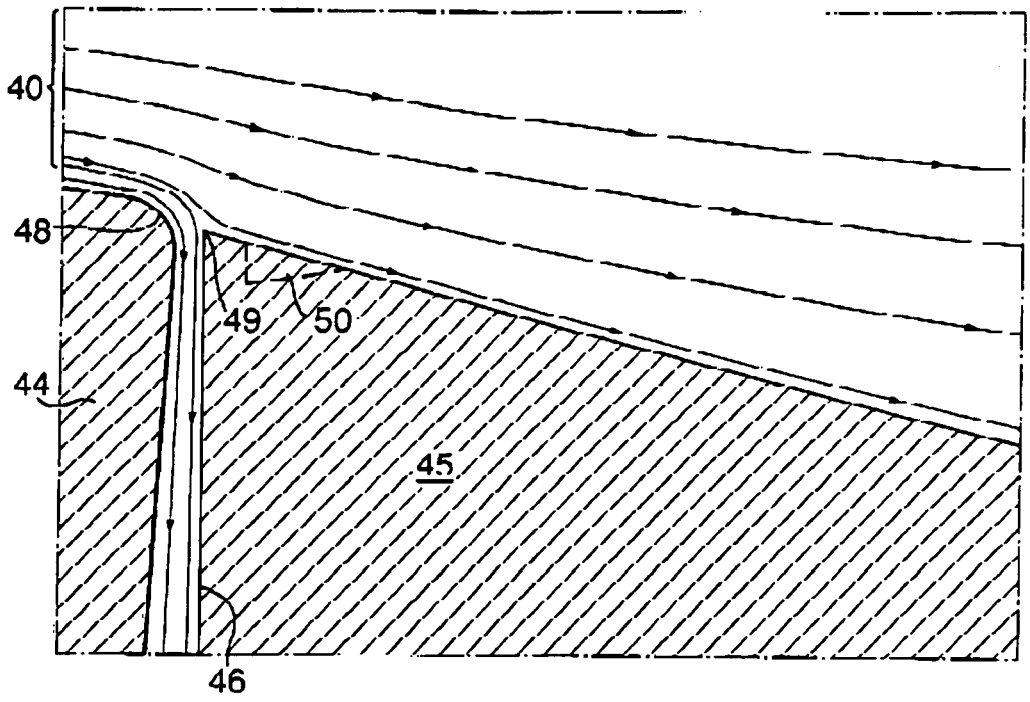
FIG. 5 is a more detailed graphic depiction of air flows about an aperture in accordance with the present invention; and, FIG. 6 is a schematic cross-section of a diffuser arrangement in accordance with the present invention located adjacent a combustor within an engine.

FIGS. 4 and 5 graphically illustrate fluid air flow about an aperture 46. Thus, an upstream part 45 includes a leading edge 48 which presents an air flow shown by streamlines 40 to the aperture 46. A downstream part 45 is presented on the other side of the aperture 46 with an angular trailing edge 49. In such circumstances, as the air flow shown by streamlines 40 passes through a diffuser arrangement it can be shown that air flow near to the wall surface is drawn into the aperture over an appropriately shaped leading edge 48 and accelerates. Thus, a mechanism is set up by which positive streamwise momentum is transferred from the accelerating bleed flow to the diffusing/decelerating mainstream flow preventing flow separation on the highly aerodynamically loaded edge 48 of part 45. Clearly, as described previously the objective is to maintain attached flow throughout the diffuser arrangement. Thus, as can be seen in FIG. 4 the isometric spacing of the streamlines is substantially retained through the expansion of the diffuser arrangement.

As more clearly depicted in FIG. 5 the trailing edge 49 is substantially angular in order to achieve a more clear cut cleavage in the air flow depicted by arrow lines 40. The leading edge 48 of the aperture 46 is substantially curved. The bleed flow accelerates into the bleed duct 46 over the curved edge 48. The profile of the curve prevents flow separation from edge 48. A free shear layer between the accelerating bleed flow and diffusing mainstream flow facilitates a transfer of streamwise momentum from the bleed flow to the mainstream flow thus preventing separation. The aperture 46 in itself has walls which diverge and so create a slight pressure recovery. This is done to improve the quality of the bleed air making it more suitable for cooling purposes.

In short, the present invention provides a localised feature about the aperture 46 between the leading edge 48 and the trailing edge 49 which incorporates the combined effects of a step change or displacement in the wall surface formed by those parts 44, 45 as part of the conduit along with preferably a specifically shaped leading edge 48 to enhance flow momentum into the aperture 46. In effect, by rendering the leading edge 48 curved there is a progressive expansion of the available opening to the aperture 46 which induces flow into the aperture 46 by an action of conservation of momentum and flow pressure.

Figure 6:
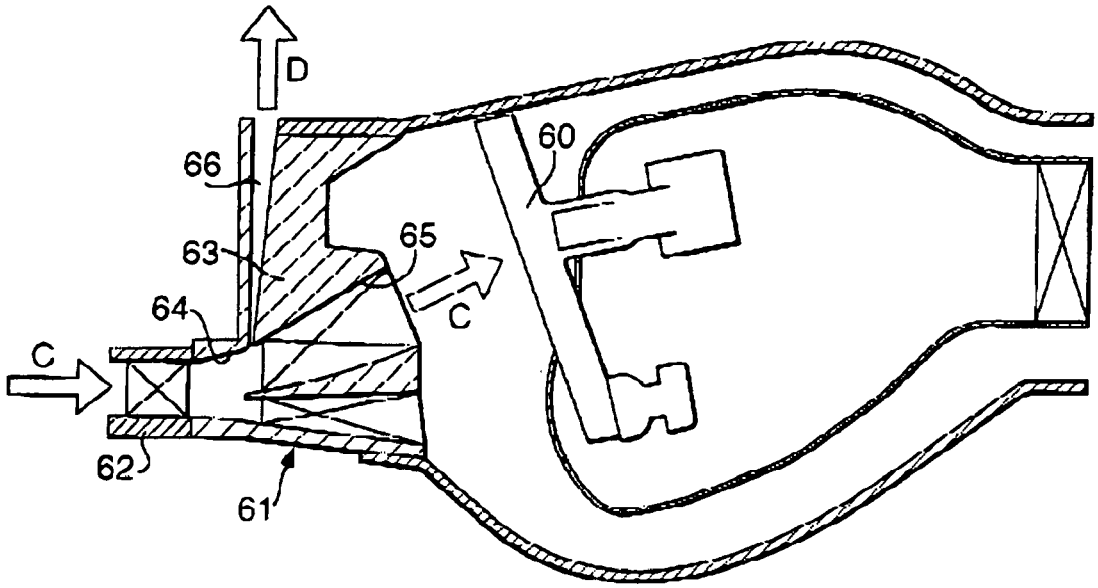

FIG. 6 illustrates a diffuser arrangement 61 in accordance with the present invention associated with a combustor 60. The diffuser arrangement 61 is located to receive an air flow in the direction of arrow head C through an inlet 62 the diffuser arrangement 61 incorporates an aperture 66 between an upstream part 64 and a downstream part 65 of a wall surface 63 which in turn is part of a conduit directing the air flow in the direction of arrow head C towards the combustor 60. The aperture 66 as described previously draws or bleeds air from the air flow in the direction of arrow head C by a combination of a step displacement change in the wall surface 63 between the upstream part 64 and the downstream part 65 as well as providing a leading edge to that aperture 66 which facilitates diversion of air flow into the aperture 66. This air flow in the direction of arrow head D will generally be utilised for coolant about the combustor 60 or other parts of an engine incorporating the combustor 60. More than one diffuser arrangement in accordance with the present invention can be provided for each conduit of air flow towards a combustor or otherwise within an engine. The relative sizes and distribution of these diffuser arrangements will be dependent upon the specific installation within an engine or relative to a combustor within that engine in order to achieve performance. As indicated previously, typically 2.5% of the air flow volume will be diffused into the present diffuser arrangement but other proportions may be achieved as required.

As indicated previously, a principal objective of the present invention is to provide a diffuser arrangement which is more easily incorporated within an engine without requiring complex fabrication or construction. However, where possible the present aperture may be associated with a flap or other device whereby diffuser arrangements in accordance with the present invention can be brought into and out of operation as required by engine performance.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A diffuser arrangement of a combustor for an engine, the diffuser arrangement located upstream of the combustor and comprising a wall surface in a fluid flow conduit formed with an aperture between an upstream part of the wall surface and a downstream part of the wall surface, the downstream part having a step displacement away from a projected profile projected in the downstream direction of the upstream part of the wall surface whereby in use flow momentum in a fluid flow past the wall surface facilitates flow bleed into the aperture; wherein the step displacement is between 0.05 to 0.12 of either the conduit radius or half the conduit cross-sectional width; the aperture has a width at the wall surface between 0.04 to 0.07 of either the conduit radius or half the conduit cross-sectional width.

2. An arrangement as claimed in claim 1 wherein the upstream part has a leading edge to the aperture shaped to enhance flow momentum thereabout towards the aperture.

3. An arrangement as claimed in claim 2 wherein the leading edge is curved into the aperture.

4. An arrangement as claimed in claim 3 wherein the leading edge has a curvature dependent upon expected flow rate and cross-section of the conduit including the wall surface.

5. An arrangement as claimed in claim 3 wherein the leading edge will have a radius between 0.05 to 0.15 of the conduit inlet passage height.

6. Apparatus as claimed in claim 5 wherein the leading edge has a radius between 0.09 to 0.11 of the conduit inlet passage height.

7. An arrangement as claimed in claim 1 wherein the downstream part has a trailing edge to the aperture which is angularly presented.

8. An arrangement as claimed in claim 1 wherein the downstream part is at an angle up to 35° to the principal axis of fluid flow in the conduit.

9. Apparatus as claimed in claim 8 wherein the angle is 30° to the principal axis of fluid flow in the conduit.

10. Apparatus as claimed in claim 1 wherein the step displacement is between 0.06 to 0.1 of either the conduit radius or half the conduit cross-sectional width.

11. An arrangement as claimed in claim 1 wherein the aperture is divergent away from an opening in the wall surface.

12. An arrangement as claimed in claim 1 wherein the width is between 0.05 to 0.06 of either the conduit radius or half the conduit cross-sectional width.

13. An arrangement as claimed in claim 1 wherein the aperture has an aperture wall upon the side towards the downstream part which is substantially perpendicular to the principal axis of fluid flow in the conduit.

14. An arrangement as claimed in claim 1 wherein the combined length of the wall surface is three to four times a conduit inlet passage height.

15. An arrangement as claimed in claim 1 wherein the aperture is coupled to a cooling system of an engine.

16. An engine incorporating a diffuser arrangement as claimed in claim 1.

17. An arrangement as claimed in claim 1 wherein the upstream part of the wall is divergent.

* * * * *